US011225806B1

(12) United States Patent
Mjelde

(10) Patent No.: US 11,225,806 B1
(45) **Date of Patent: *Jan. 18, 2022**

(54) LOW PROFILE CIRCULAR DRAIN WITH WATER STOP FOR SWIMMING POOL

(71) Applicant: Olaf Mjelde, San Diego, CA (US)

(72) Inventor: Olaf Mjelde, San Diego, CA (US)

( * ) Notice: Subject to any disclaimer, the term of this patent is extended or adjusted under 35 U.S.C. 154(b) by 22 days.

This patent is subject to a terminal disclaimer.

(21) Appl. No.: 16/673,299

(22) Filed: Nov. 4, 2019

Related U.S. Application Data

(63) Continuation of application No. 16/530,659, filed on Aug. 2, 2019, now Pat. No. 10,465,404, which is a continuation of application No. 16/439,883, filed on Jun. 13, 2019, now Pat. No. 10,745,926, which is a continuation of application No. 16/210,850, filed on Dec. 5, 2018, now Pat. No. 10,323,429, which is a continuation of application No. 15/863,236, filed on Jan. 5, 2018, now Pat. No. 10,214,930, which is a continuation of application No. 15/392,345, filed on Dec. 28, 2016, now Pat. No. 9,869,103, which is a (Continued)

(51) Int. Cl.
*E04H 4/12* (2006.01)

(52) U.S. Cl.
CPC ..... *E04H 4/1236* (2013.01); *Y10T 29/49826* (2015.01)

(58) Field of Classification Search
CPC ..... E04H 4/1236
USPC ..... 4/507
See application file for complete search history.

(56) References Cited

U.S. PATENT DOCUMENTS 680,287 A 8/1901 Steele
902,289 A 10/1908 Gribben et al.
1,255,648 A 2/1918 Sagan
(Continued)

FOREIGN PATENT DOCUMENTS

AU 760860 B2 5/2003
CN 202090428 U 12/2011
(Continued)

OTHER PUBLICATIONS

Color Match Pebble Top Drain Covers advertisement (#1), www.poolfittings.com (date unknown).

(Continued)

*Primary Examiner* — Christine J Skubinna
(74) *Attorney, Agent, or Firm* — Cislo & Thomas, LLP

(57) ABSTRACT

A sump drain includes a ring-shaped chamber having an inner sidewall with a diameter of at least about 18 inches and an outer sidewall, and a circular opening between the sidewalls preferably about an inch wide and optionally having a grid cover. Preferably the inner sidewall has a number of ports extending inwardly to radial conduits to a central hub for tying into a pool or spa filtering system, with the central hub operating as a clean out and having a removable cap. Upon installation, plaster substantially fills the space between the chamber and the central hub, such that the sump drain attractively blends in with the pool or spa floor. When installed, the top opening is preferably substantially flush with the pool or spa floor while being safely unblockable. And the sump drain preferably further includes channels both outboard and inboard from the chamber top opening and around the central hub, to help prevent water from passing through the plaster into the shotcrete of the pool or spa.

20 Claims, 9 Drawing Sheets

Related U.S. Application Data continuation of application No. 13/794,376, filed on Mar. 11, 2013, now Pat. No. 9,540,837.

(60) Provisional application No. 61/734,267, filed on Dec. 6, 2012, provisional application No. 61/660,566, filed on Jun. 15, 2012.

(56) References Cited

U.S. PATENT DOCUMENTS

| | | | |
|---|---|---|---|
| 1,605,242 | A | 11/1926 | Keys |
| 1,689,646 | A | 10/1928 | Tutsch |
| 1,937,732 | A | 12/1933 | Tverdak |
| 2,518,205 | A | 8/1950 | Vinokor |
| 3,378,858 | A | 4/1968 | Jacuzzi |
| 3,709,435 | A | 1/1973 | Sheets |
| 3,800,486 | A | 4/1974 | Harvey |
| 3,829,910 | A | 8/1974 | Kaufman |
| 3,940,807 | A | 3/1976 | Baker |
| 4,010,901 | A | 3/1977 | Sheets |
| 4,013,374 | A | 3/1977 | Weiler et al. |
| 4,170,047 | A | 10/1979 | Corsette et al. |
| 4,188,674 | A | 2/1980 | Mardirosian |
| D260,170 | S | 8/1981 | Cornwall |
| 4,300,246 | A | 11/1981 | Gould |
| 4,322,860 | A | 4/1982 | Gould |
| 4,429,832 | A | 2/1984 | Sheets |
| 4,462,123 | A | 7/1984 | Morris et al. |
| 4,561,134 | A | 12/1985 | Mathews et al. |
| 4,658,449 | A | 4/1987 | Martin |
| 4,666,333 | A | 5/1987 | Armstrong |
| D299,522 | S | 1/1989 | Chalberg |
| 4,815,888 | A | 3/1989 | Stegmeier |
| 4,825,477 | A | 5/1989 | Aranda |
| 4,838,732 | A | 6/1989 | Clark et al. |
| 4,923,946 | A | 5/1990 | Meddaugh |
| 4,957,268 | A | 9/1990 | Picollo et al. |
| 5,003,735 | A | 4/1991 | Bates |
| D319,295 | S | 8/1991 | Ohaus |
| D333,342 | S | 2/1993 | Newhard |
| 5,234,582 | A | 8/1993 | Savoie |
| 5,251,343 | A | 10/1993 | Goettl |
| 5,268,096 | A | 12/1993 | Robol |
| D343,228 | S | 1/1994 | Colin |
| 5,330,811 | A | 7/1994 | Buchalter |
| 5,341,523 | A | 8/1994 | Barnes |
| D351,220 | S | 10/1994 | Barnes |
| 5,360,284 | A | 11/1994 | Allard |
| 5,408,706 | A | 4/1995 | Barnes |
| 5,427,417 | A | 6/1995 | Lechuga |
| 5,458,769 | A | 10/1995 | Johannessen |
| 5,689,928 | A | 11/1997 | Rasksen |
| 5,724,648 | A | 3/1998 | Shaughnessy et al. |
| 5,729,937 | A | 3/1998 | Mantelli |
| 5,734,999 | A | 4/1998 | Nicholas |
| 5,799,339 | A | 9/1998 | Perry et al. |
| 5,809,587 | A | 9/1998 | Fleischer |
| 5,843,306 | A | 12/1998 | Singleton |
| 5,923,865 | A | 7/1999 | Chilton et al. |
| 5,996,134 | A | 12/1999 | Senninger |
| 6,109,822 | A | 8/2000 | Campbell et al. |
| 6,170,095 | B1 | 1/2001 | Zars |
| 6,209,586 | B1 | 4/2001 | Wright |
| 6,230,337 | B1 | 5/2001 | Barnett |
| 6,314,590 | B1 | 11/2001 | Lee |
| 6,340,035 | B2 | 1/2002 | Wright |
| 6,397,408 | B1 | 6/2002 | Veloskey et al. |
| 6,419,840 | B1 | 7/2002 | Meincke |
| D466,596 | S | 12/2002 | Stegmeier et al. |
| 6,557,588 | B2 | 5/2003 | Wright |
| 6,595,243 | B2 | 7/2003 | Tarr |
| 6,810,537 | B1 | 11/2004 | Barnes |
| 7,089,607 | B2 | 8/2006 | Barnes et al. |
| 7,178,179 | B2 | 2/2007 | Barnes |
| 7,415,802 | B2 | 8/2008 | Froeter |
| D613,829 | S | 4/2010 | Griffin |
| 7,739,757 | B2 | 6/2010 | Witt |
| D621,009 | S | 8/2010 | Mjelde |
| 7,774,870 | B2 | 8/2010 | Griffin |
| D623,727 | S | 9/2010 | Mjelde |
| D623,728 | S | 9/2010 | Mjelde |
| 7,788,743 | B2 | 9/2010 | Mjelde |
| 7,862,729 | B2 | 1/2011 | Stetson |
| 7,992,236 | B2 | 8/2011 | Degooyer |
| 7,996,931 | B2 | 8/2011 | Plette |
| D663,387 | S | 7/2012 | Mjelde |
| D663,388 | S | 7/2012 | Mjelde |
| 8,272,078 | B2 | 9/2012 | Snow et al. |
| 8,281,427 | B2 | 10/2012 | Afshar |
| 8,557,109 | B1 | 10/2013 | Sutherland |
| 8,627,519 | B2 | 1/2014 | Jacobs |
| 8,713,724 | B1 | 5/2014 | Goettl et al. |
| 9,540,837 | B2 | 1/2017 | Mjelde |
| 9,790,699 | B2 | 10/2017 | Mjelde |
| 9,869,103 | B1 | 1/2018 | Mjelde |
| 2002/0192028 | A1 | 12/2002 | Carston |
| 2004/0093666 | A1 | 5/2004 | Zars |
| 2005/0150040 | A1 | 7/2005 | Barber |
| 2006/0015996 | A1 | 1/2006 | Goettl |
| 2006/0015997 | A1 | 1/2006 | Barnes |
| 2006/0053544 | A1 | 3/2006 | Hui |
| 2006/0218714 | A1 | 10/2006 | Mjelde et al. |
| 2007/0266489 | A1 | 11/2007 | Martin |
| 2008/0098506 | A1 | 5/2008 | Mjelde |
| 2008/0189926 | A1 | 8/2008 | Luxton |
| 2008/0282466 | A1 | 11/2008 | Swan |
| 2009/0019633 | A1 | 1/2009 | Snow et al. |
| 2009/0320204 | A1 | 12/2009 | Wiseman et al. |
| 2012/0018362 | A1 | 1/2012 | Swanston |
| 2012/0023658 | A1 | 2/2012 | Bobeck et al. |
| 2012/0036629 | A1 | 2/2012 | Cook |
| 2012/0036630 | A1 | 2/2012 | Cook |
| 2012/0036631 | A1 | 2/2012 | Cook |
| 2012/0036632 | A1 | 2/2012 | Cook |
| 2012/0036697 | A1 | 2/2012 | Cook |
| 2012/0167295 | A1 | 7/2012 | Fima |
| 2013/0061387 | A1 | 3/2013 | Stetson et al. |
| 2019/0218807 | A1 | 7/2019 | Goettl et al. |

FOREIGN PATENT DOCUMENTS

| | | | |
|---|---|---|---|
| DE | 215355 | A1 | 11/1984 |
| DE | 8600726 | U1 | 3/1987 |
| DE | 202005004087 | U1 | 5/2005 |
| DE | 202011001135 | U1 | 12/2011 |
| EP | 1243709 | A2 | 9/2002 |
| GB | 2431101 | A | 4/2007 |
| KR | 20-1995-0005536 | Y1 | 7/1995 |
| KR | 20-2008-0006173 | U | 12/2008 |
| PH | 1000116 | | 11/2006 |

OTHER PUBLICATIONS

Color Match Pebble Top Drain Covers advertisement (#2), www.poolfittings.com (date unknown).

Color Match Drain Cover Installation Instruction Sheet (date unknown).

"MDX Debris Removal System Manual", Paramount Pool & Spa Systems, Copyright 2006.

https://www.aquastarpoolproducts.com/ItemCatalog/FittingAquaStop%C2%AE-Pipe-Sleeve-with-Threaded-Slurry-Seal-Cap-and-O-ring-1%22-%2F-1%C2%BD%22-%2F-2%22-%2F-2%C2%BD%22-%2F-3%22, 2 pages excerpted from online product information available at https://www.aquastarpoolproducts.com, containing substance of Pipe Sleeve with Threaded Slurry product images and info as published in Aquastar Product Catalog, Summer 2010.

https://www.aquastarpoolproducts.com/ItemCatalog/FittingAquaStop%C2%AE-Pipe-Sleeves-(1%22-%2F-1.5%22-%2F-2%22-%2F-2.5%22%2F-3%22), 3 pages excerpted from online product catalog information at https://www.aquastarpoolproducts.com, containing substance of Pipe Sleeves product images and info as published in Aquastar Product Catalog, Summer 2010.

(56) References Cited

OTHER PUBLICATIONS

"1-½ Inch Threaded Wall Fitting with Water Barrier 100/Case"; Color Match Pool Fittings, Inc.; 2 pages; originally available at http://poolfittings.com/order.php on Feb. 8, 2011; currently available at web.archive.org.
"10 inch Drain—Safety & Debris Removal"; A&A Manufacturing; (Publication Date Could Not Be Independently Verified); 2 pages.
"PDR Drain (Powerful Debris removal)"; A&A Manufacturing; 1 page; originally available at http://aamfg.com/pdrDrain.php on Apr. 21, 2011; currently available at web.archive.org/web/20110421202720/http://aamfg.com/pdrDrain.php.
"PDR2 Drain (Powerful Debris removal)"; A&A Manufacturing; 1 page; originally available at http://aamfg.com/pdr2Drain.php on Dec 11, 2011; currently available at web.archive.org/web/20111211184054/http://aamfg.com:80/pdr2Drain.php.
"16 CFR 1450—Virginia Graeme Baker Pool and Spa Safety Act Regulations"; 1 page; Jan. 1, 2011.
Pleadings Paper from Civil Action No. 5:18-cv-00094-GW-SPx; "Defendant Color Match Pool Fittings, Inc.'s Answer to Third Amended Complaint for Patent Infringement, and Counterclaims" (United States District Court for the Central District of California, Eastern Division, Jul. 11, 2019).

LOW PROFILE CIRCULAR DRAIN WITH WATER STOP FOR SWIMMING POOL

RELATED APPLICATIONS

This application is a continuation of co-pending U.S. patent application Ser. No. 16/530,659 entitled "Low Profile Circular Drain With Water Stop For Swimming Pool," which is a continuation of U.S. patent application Ser. No. 16/439,883, a continuation of U.S. patent application Ser. No. 16/210,850, now U.S. Pat. No. 10,323,429, a continuation of U.S. patent application Ser. No. 15/863,236, now U.S. Pat. No. 10,214,930, a continuation of U.S. patent application Ser. No. 15/392,345, now U.S. Pat. No. 9,869,103, a continuation of U.S. patent application Ser. No. 13/794,376, now U.S. Pat. No. 9,540,837, which claims priority to provisional application No. 61/660,566 filed Jun. 15, 2012 entitled "Low Profile Circular Drain Covers," and to provisional application No. 61/734,267 filed Dec. 6, 2012 entitled "Channel Drain With Water Stop."

BACKGROUND

Twin 7-Year Old Virginia Graham Baker was the granddaughter of former Secretary of State James Baker III. In June 2002 she became stuck to the hot tub drain and was unable to pull herself free and she drowned. After her tragic death the family lobbied Congress for a law to require anti-entrapment drain covers and other safety measures. As a result, The Virginia Graham Baker Pool & Spa Safety Act ("VGB Act") was enacted in December, 2007. The 2007 VGB Act changed everything for those in business of providing swimming pool and spa suction outlets or drains. Among one of the ways of complying with the Act was separating two drains by more than three feet, such that a single individual could not likely block both drains with his or her body and become stuck. This also led to increased popularity of channel drains, rectangular and longer than three feet, which accomplished this objective but looked unsightly.

Even before the VGB Act, pool manufacturers were concerned about the aesthetic appearance of drains and were developing products and methods towards making drain covers more attractive. Among products available were small approx. 12 inch diameter round covers having a recessed upper surface forming a cavity to receive aggregate material matching the aggregate surface of the pool. Among disadvantages of this product were that the aggregate material was retained inside a portion of the cover itself, such that changing covers requires filling the new cover with matching new batch of the aggregate material. And also, these small drains are subject to being damaged by being kicked by swimmers and users of hot tubs.

Pool drains or sumps, as currently known in the art, generally comprise a plastic or fiberglass body including a chamber into which water flows from the pool as it gets recycled through the pool's pump and filter. The chamber includes an opening, or outlet port, that connects to a pipe extending to the pool pump and filter apparatus. Pipes are typically installed in gunite or shotcrete material forming the supporting walls of the pool. The terminal end of a pipe is then encased in plaster along with the drain to which it is connected. The plaster covers the gunite or shotcrete and serves as a barrier between water in the pool and the gunite or shotcrete.

As alluded to above, elongate channel sumps are popular in view of their compliance with the VGB Act, requiring swimming pool and spa sumps to prevent a person's body from covering the entire sump intake and becoming entrapped. Anti-entrapment channel sumps generally comply with the VGB Act by providing multiple intake ports, and being of a sufficient length that the ports cannot be simultaneously blocked, i.e., if one intake port is blocked, the other intake ports allow water to continue to flow into the pump and filtering system.

A problem with pool sumps, particularly elongated channel sumps, is that the plaster into which these large sumps are embedded forms cracks over time. One area most prone to form cracks is where the pool sump and plaster meet. Water may seep into the surrounding plaster and then down into the supporting walls of the pool causing damage. It therefore would be advantageous to provide a pool sump that helps prevent water from migrating down cracks as they form between the pool sump and the plaster surrounding it.

SUMMARY

A sump drain for connecting to a filtering system and embedding in the plaster floor of a swimming pool or spa includes an annular or ring-like shaped chamber having an inner sidewall with a diameter of at least about 18 inches and an outer sidewall, and an annular top opening between the sidewalls preferably about an inch wide. The chamber, preferably the inner sidewall, has a plurality of ports to radial conduits extending inwardly to a central hub for tying into the pool or spa filtering system, with the central hub operating as a clean out and having a removable cap.

The sump drain further preferably includes a circular grid, sized to cover the top opening and having a multiplicity of openings in it, or alternatively the drain may be configured to provide a narrow gap between inner and outer sidewalls and be used without a grid cover. The sump drain is configured such that upon installation plaster substantially fills the space between the chamber and the central hub; thereby the sump drain attractively blends in with the pool or spa floor. When the drain is installed the top opening is preferably substantially flush with the pool or spa floor, and being of sufficiently large size to be unblockable. The sump drain preferably further includes channels both outboard and inboard from the chamber top opening, to help prevent water from passing through the plaster and into the shotcrete of the pool or spa.

Installing the sump drain in a plaster floor of a swimming pool or spa for connection to a filtering system, includes the steps of providing the sump drain having the generally annular-shaped chamber with a diameter of at least about 18 inches and conduits which extend to the central hub; placing the sump drain in the floor of the pool or spa near the filtering system; connecting the central hub to the filtering system; and embedding the sump drain in the pool or spa including covering it with plaster between the annular chamber and the hub. Preferably prior to embedding the sump drain in the pool or spa, a temporary cover on the sump drain prevents plaster from getting inside the chamber.

DETAILED DESCRIPTION

Figure 1:
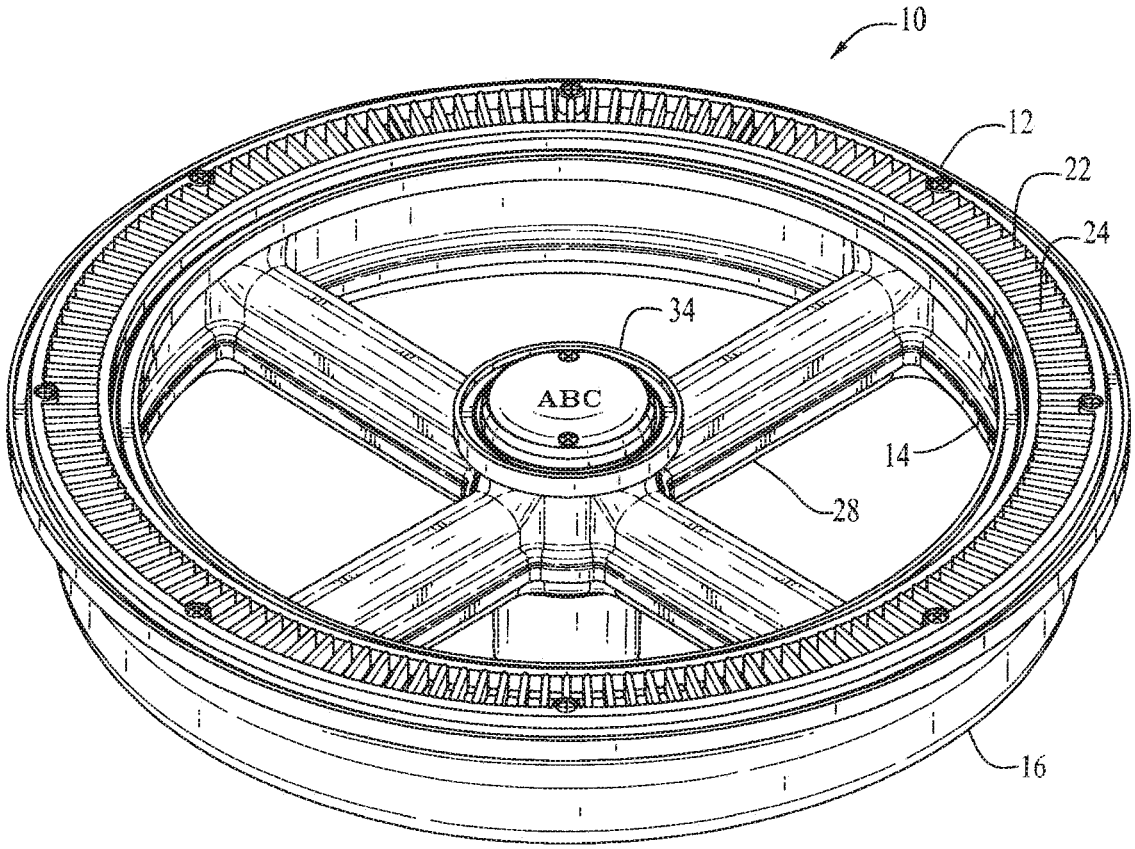
FIG. 1 is a perspective view of a preferred embodiment circular drain assembly.
Figure 2:
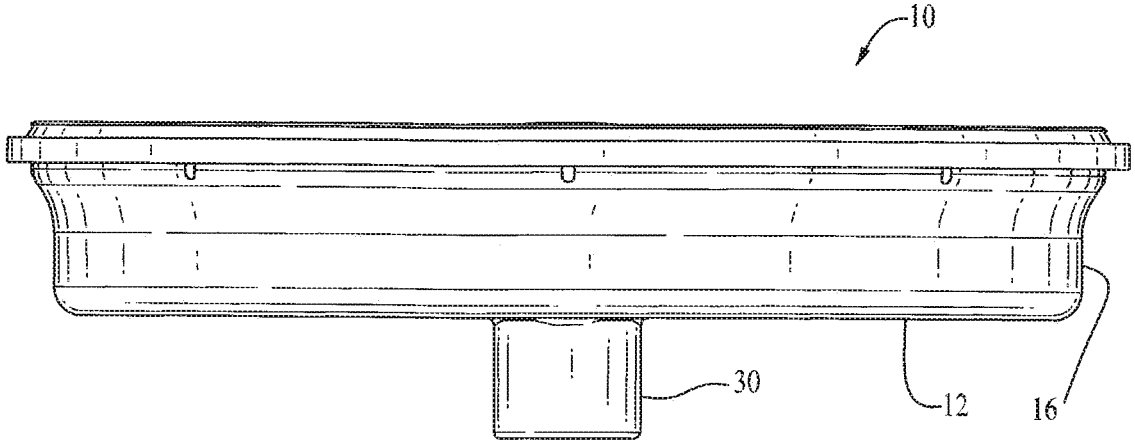
FIG. 2 is a side elevation view of the preferred embodiment circular drain assembly.
Figure 3:
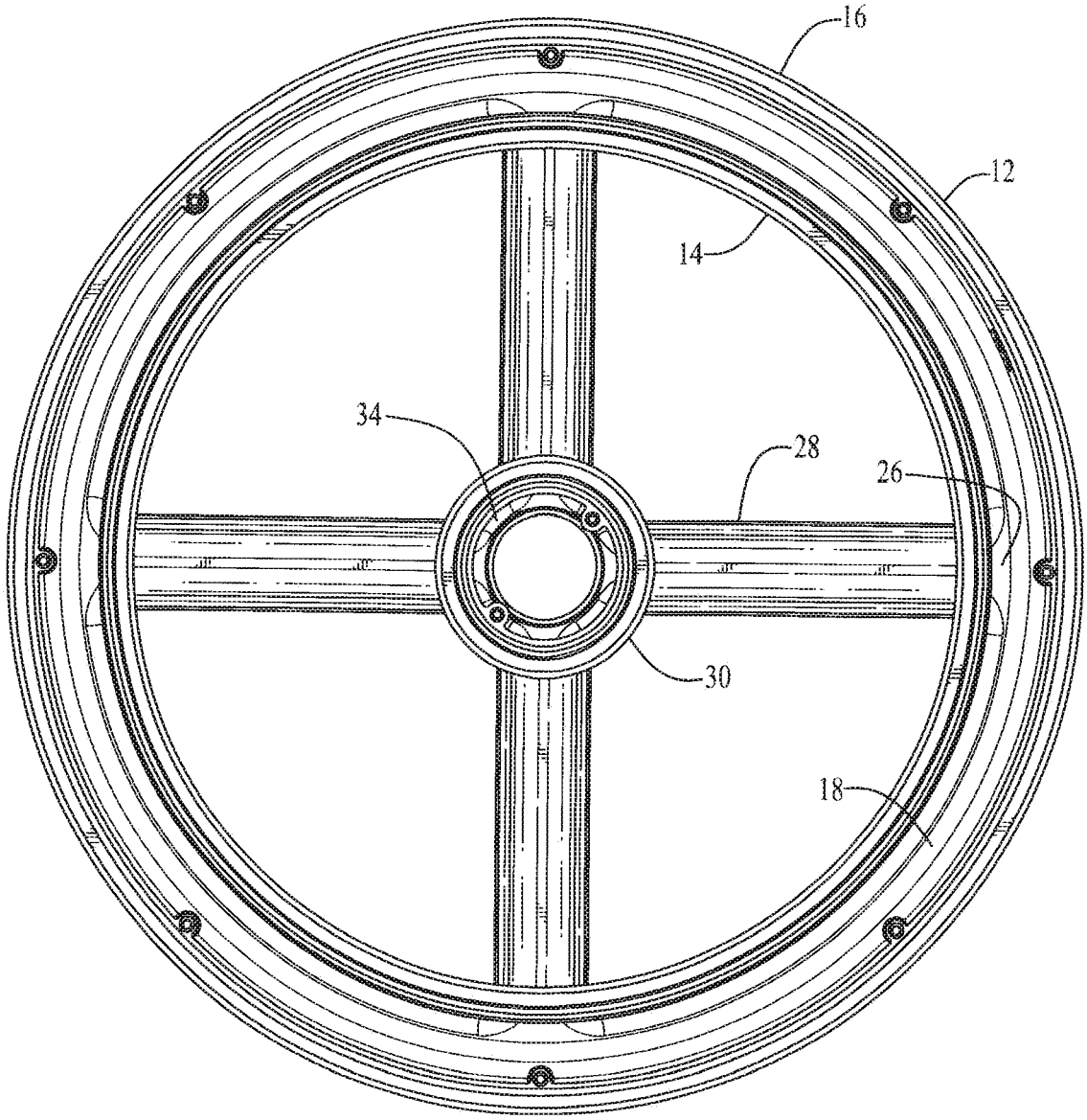
FIG. 3 is a top plan view of the preferred embodiment circular drain assembly.

Referring to drawing FIGS. 1-11, the low profile circular drain 10 or suction outlet or sump of the preferred embodiment is disclosed. As best shown in FIGS. 1-3, the drain 10 has an annular ring-shaped body or chamber 12 although optionally the drain 10 may be other preferably rounded shapes such as oval or merely with rounded corners (not shown). The chamber 12 has an inner sidewall 14 having a diameter of about 18 inches (dimension D as labeled in FIG. 7) and outer sidewall 16 having an outside diameter of about 21 inches, and the depth of the chamber from top to bottom is about 3.5 inches. The top side of the chamber 12 is generally open, forming an annular or ring-shaped space 18 between the sidewalls 14, 16, which may be sized to receive a corresponding circular grid cover 22. The grid cover 22 may include a large number (here there are about 150) rectangular, radial slots 24. Optionally, the cover 22 may have other types of openings (not shown), most anything that allows water to pass through while stopping larger debris such as leaves.

The inner sidewall 16 has multiple openings or outlet ports 26 connecting to one or more conduits or pipes 28. The conduits 28 extend radially inward to a central hub 30 that connects to the pump and filtering system 32 in the floor of the pool or spa. The hub 30 preferably has about a 2.5 inch inner diameter, and its length from the bottom of the chamber 12 to the end is about 2.5 inches. The top side of the hub 30 includes a cap 34 on which a manufacturer's logo, here ABC, may be displayed, and the cap 34 is removable for purposes of cleaning out the drain 10 should it become clogged with debris. It's held on by a pair of flat head Phillips screws 36 (FIG. 5).

Figure 4:
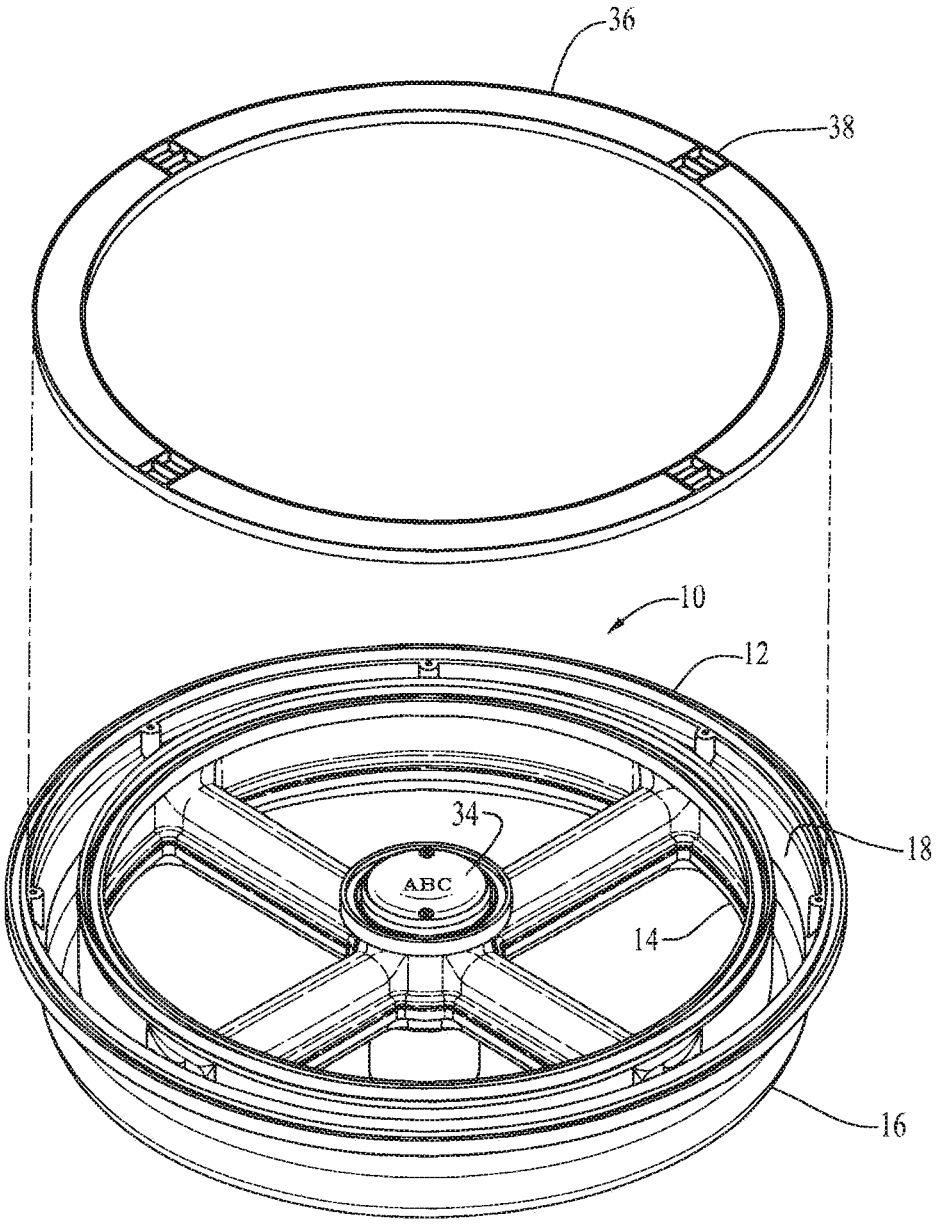
FIG. 4 is a perspective exploded view of the preferred drain assembly with the temporary plaster cover.
Figure 5:
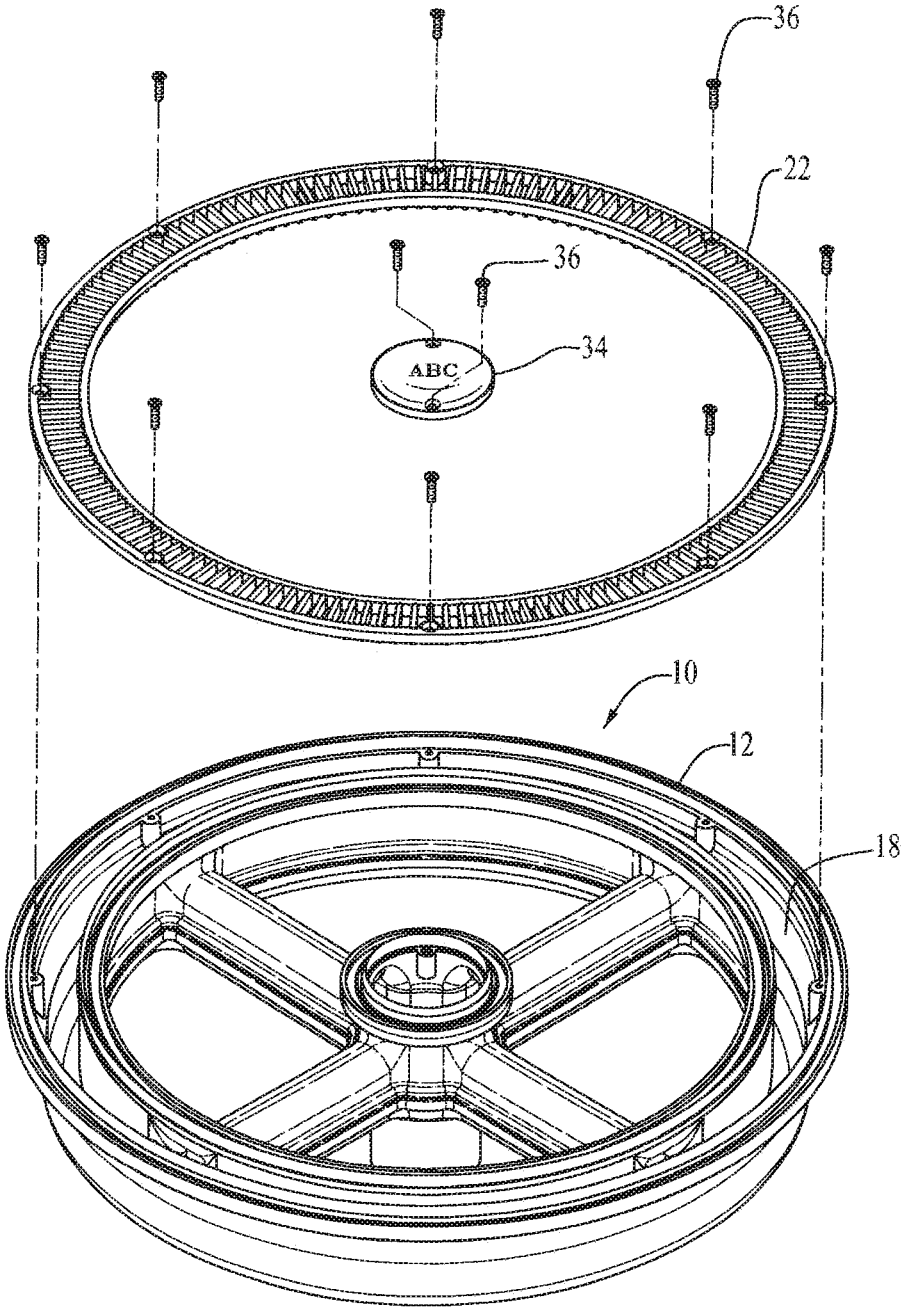
FIG. 5 is an exploded view of the preferred drain assembly with the grid cover, and also showing the removability of the center cover.
Figure 6:
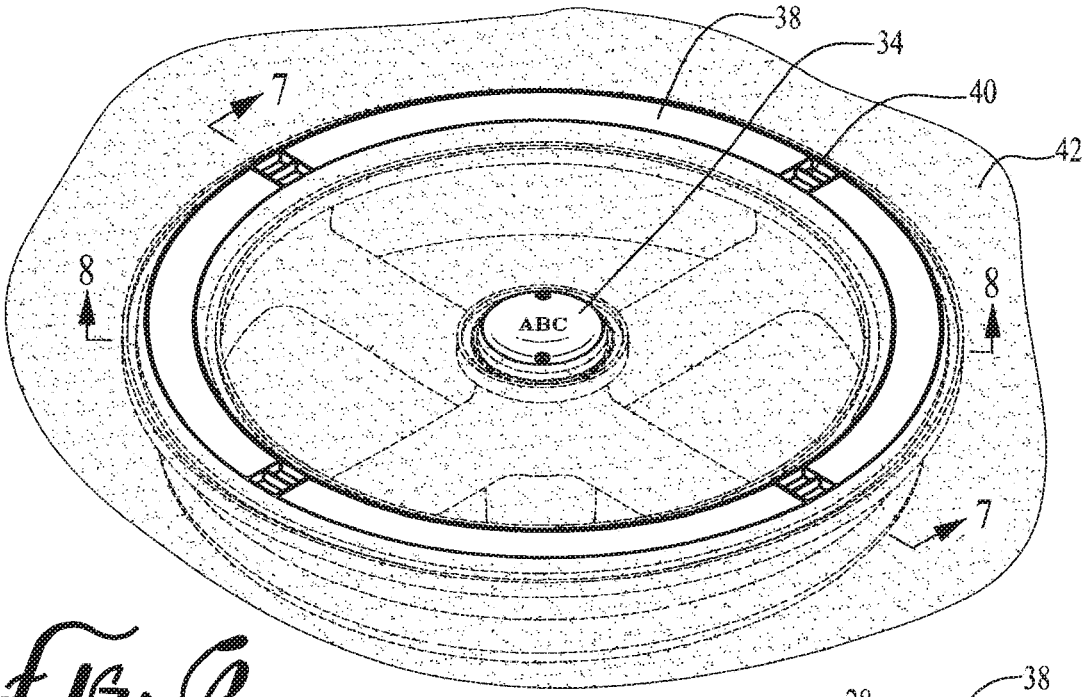
FIG. 6 is a perspective view showing the preferred drain installed into the surface of a pool with the plaster cover.
Figure 7:
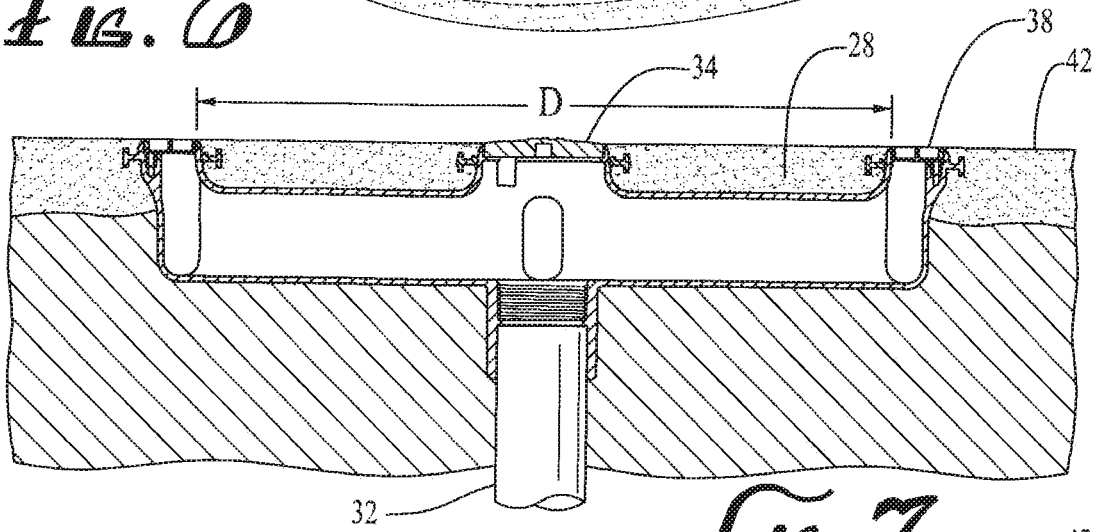
FIG. 7 is a section view taken from FIG. 6.
Figure 8:
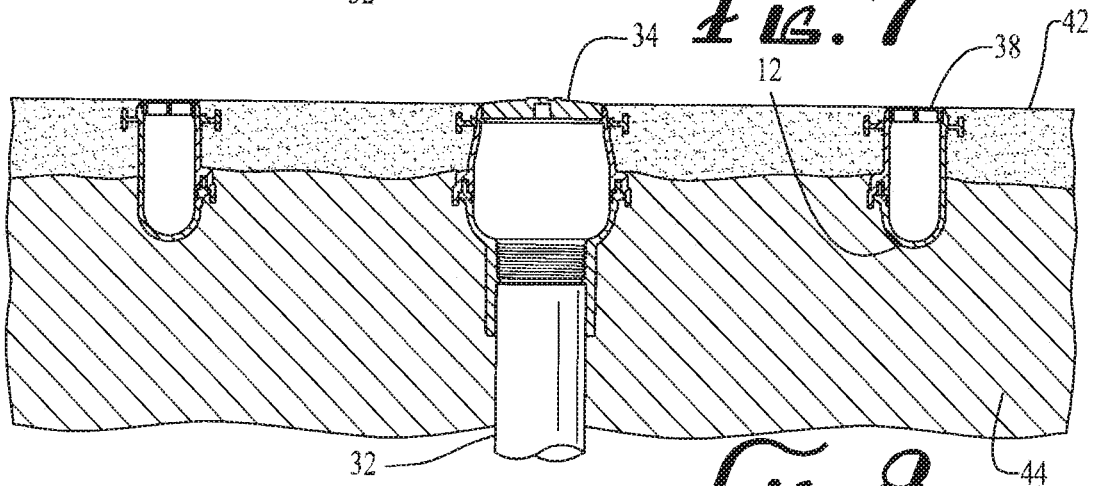
FIG. 8 is a perspective view showing the preferred drain with the grid cover installed in a pool.

Next referring to FIGS. 4-12, installation of the drain 10 as well as further features may be described. FIG. 4 shows a plastering cover 38 which is temporarily placed in the chamber 12 opening 18, to keep plaster from getting into the chamber 12 when the drain 10 is being installed in the floor of a pool or spa. The plastering cover 38 preferably includes several, at least two thumb/index finger holds 40 for facilitating later removal of the plastering cover 36 once the drain 10 is embedded in the pool or spa. FIG. 5 shows the grid cover 22 which is then added, held on by eight (8) screws 36. FIG. 6 shows the drain 10 being installed in the plaster surface 42 floor of a swimming pool or spa, with the plaster 42 covering up the temporary cover 38 and the center hub cap 34. Optionally, it may also be installed vertically in a lower wall of a pool or spa (not shown). FIG. 7 shows the top side opening 18 into which the plastering cover 34 fits, along with the hub cover 34 (also see FIG. 12), being substantial flush with the plaster surface 42. FIG. 8 shows that there is a substantial amount of plaster 42, as well as the underlying gunite or shotcrete material 44, between the annular chamber 12 and the center hub 30. With the drain 10 being installed in this fashion, it offers improved structural integrity in that any load from a swimmer's foot or occupant of a hot tub will impact only a small portion of the drain 10 and tend to be absorbed by the surrounding floor or wall of the pool or spa.

Figure 9:
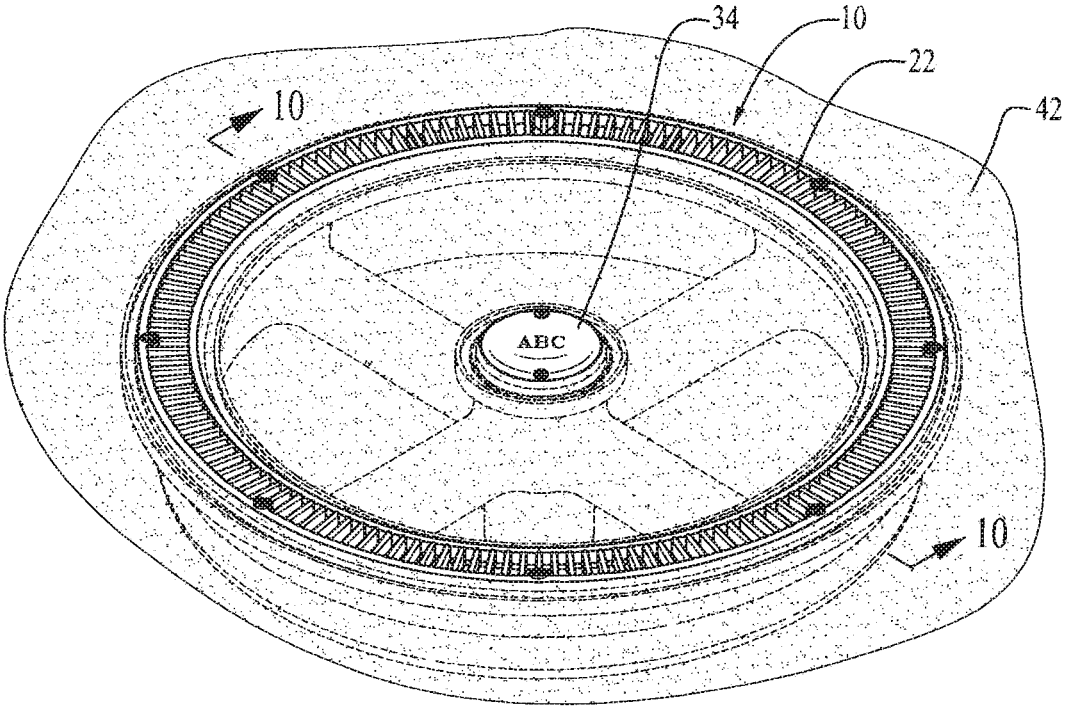
FIG. 9 is a section view taken from FIG. 8.
Figure 10:
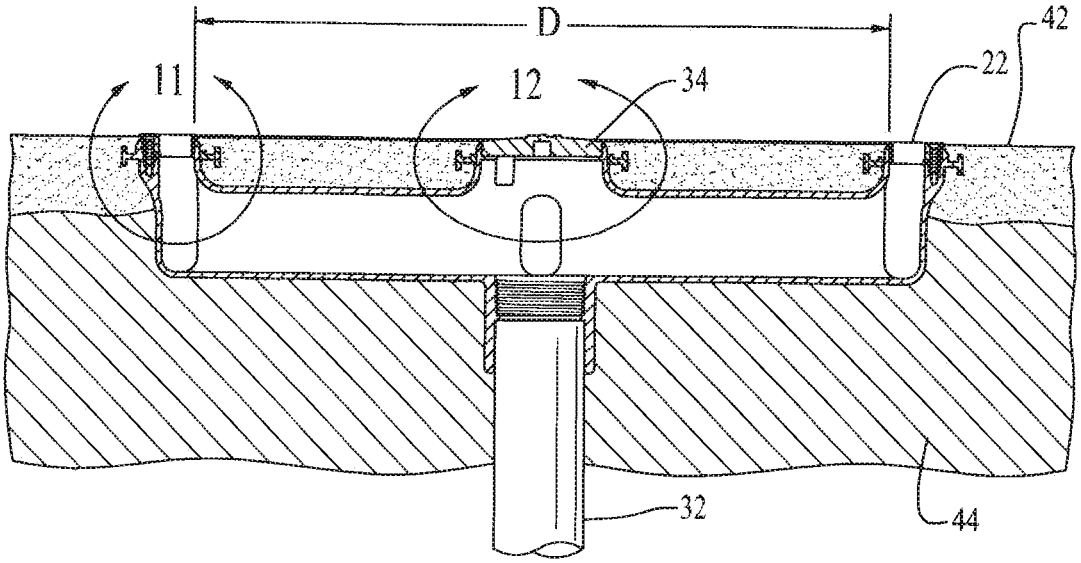
FIG. 10 is an enlarged section view showing the grid cover installed and the water stop feature.
Figure 11:
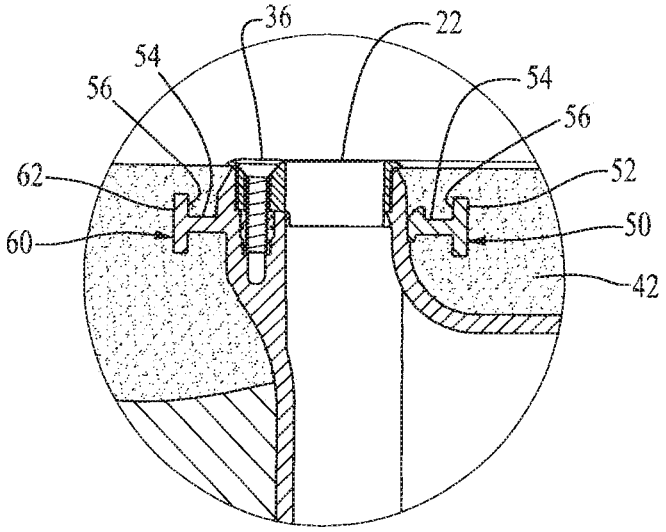
FIG. 11 is an enlarged section view showing the center cover installed and again the water stop feature.
Figure 12:
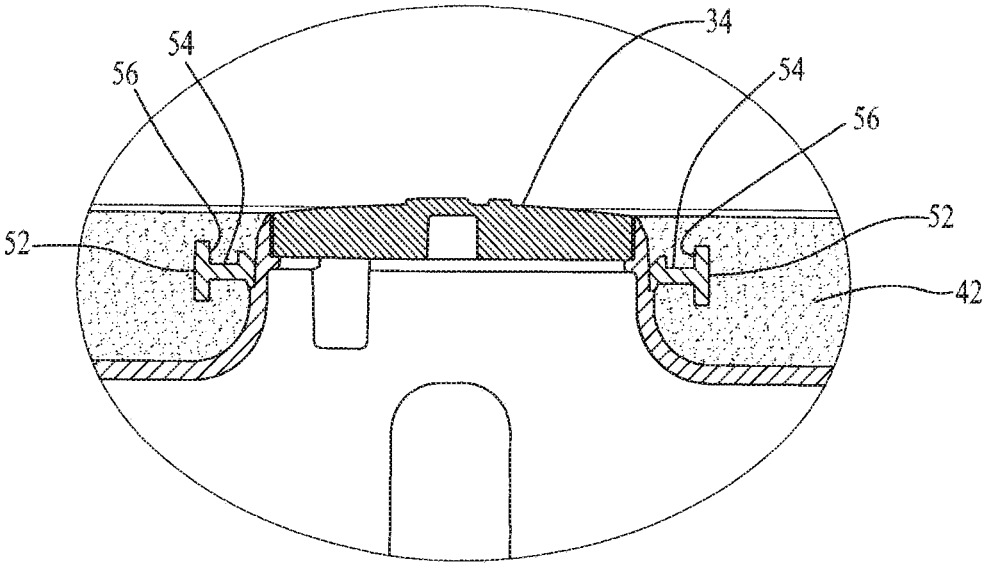
FIG. 12 is a perspective view of the alternate embodiment circular drain assembly.
Figure 13:
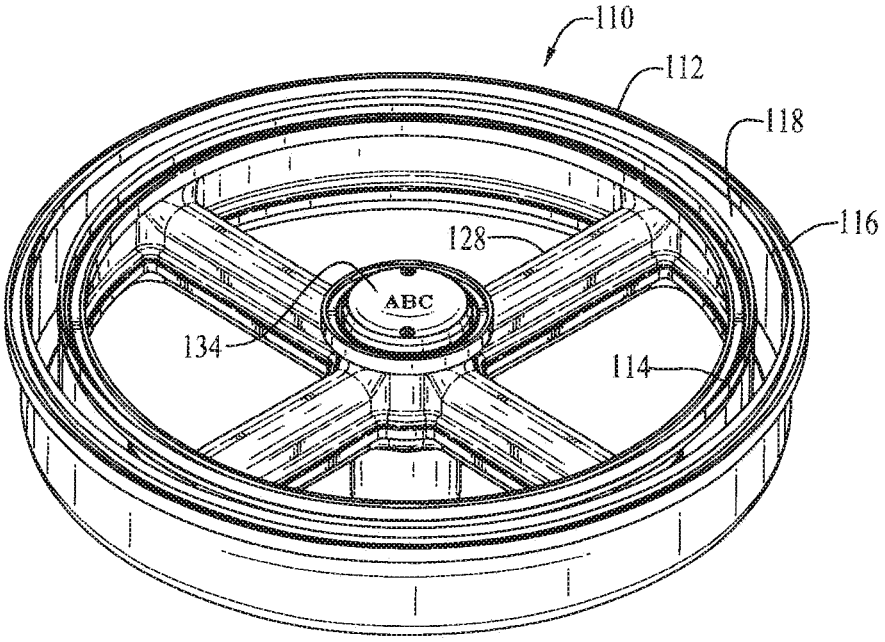
FIG. 13 is a perspective view of the alternate drain installed in a pool.
Figure 14:
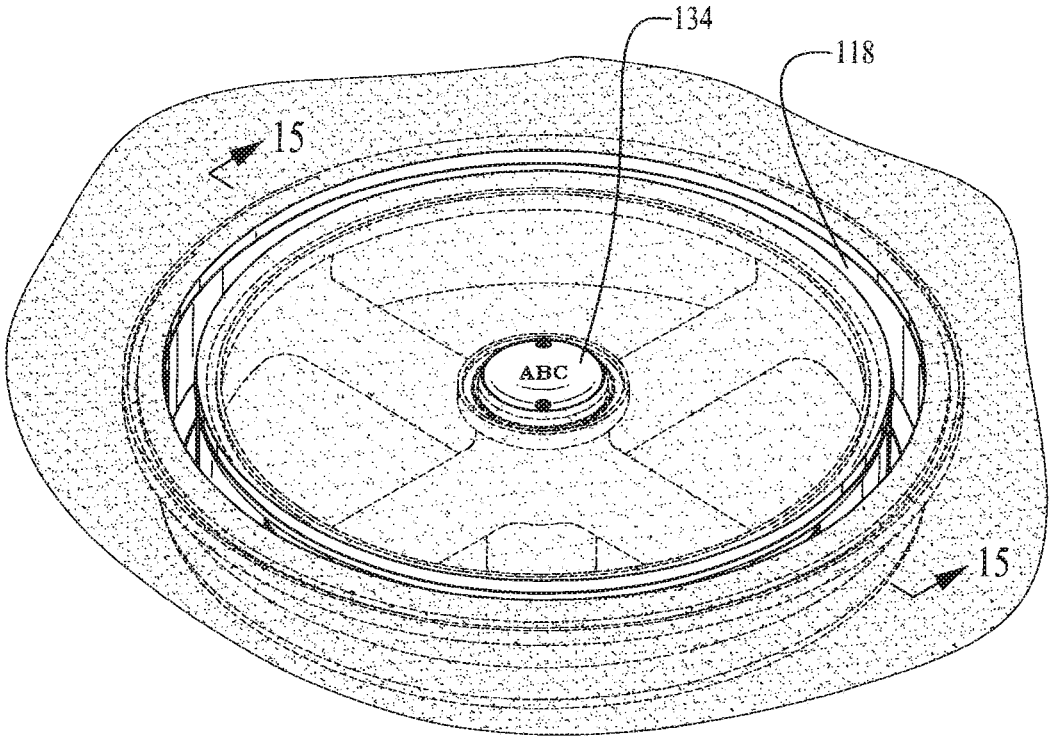
FIG. 14 is section view taken from FIG. 13.

FIGS. 9, 10 shows the plastering cover 34 removed and replaced with the grid cover 22. As indicated in FIG. 5, the grid cover is secured in place in the top opening 18 by several Phillips head screws 36. Thus, the grid cover 22 and center cap 34 are the only parts of the drain 10 seen upon installation, and they blend into the plaster surface 42 of the floor of the pool or spa. FIG. 11 shows the cover 22 is substantially flush with the surrounding plaster 42, and as per FIG. 12 the center hub cap 34 is similarly substantially flush with the plaster 42 floor. [FIGS. 11, 12 also show water stops 50, 60 for stopping any water that intrudes between the sump 10 and plaster 42 into which the sump 10 is embedded. In the preferred embodiment the water stop 50, 60 is tray-shaped like a gutter or channel 52, 62 and extends around the sump 10 to collect water seeping into cracks between the sump 10 and the plaster 42. The water stop 50 also serves to anchor the sump 10 in the plaster 42. The gutter or channel 52 is located inboard the grid cover 22, and the same channel 52 is built in around the hub cover 34. A slightly differently configured water stop 60 is located outboard the grid cover 22, as the gutter or channel 52 is molded into the chamber body 22 adjacent to the screws 36 which attach the cover 22. Each water stop 50, 60 preferably includes a horizontal shelf 54 and a vertical wall 56, again to catch water migrating between the sump 10 and the plaster 42 in which the sump 10 is installed. The vertical wall 56 may extend above and below the horizontal shelf 54, providing an effective anchoring mechanism during sump 10 installation.

Figure 15:
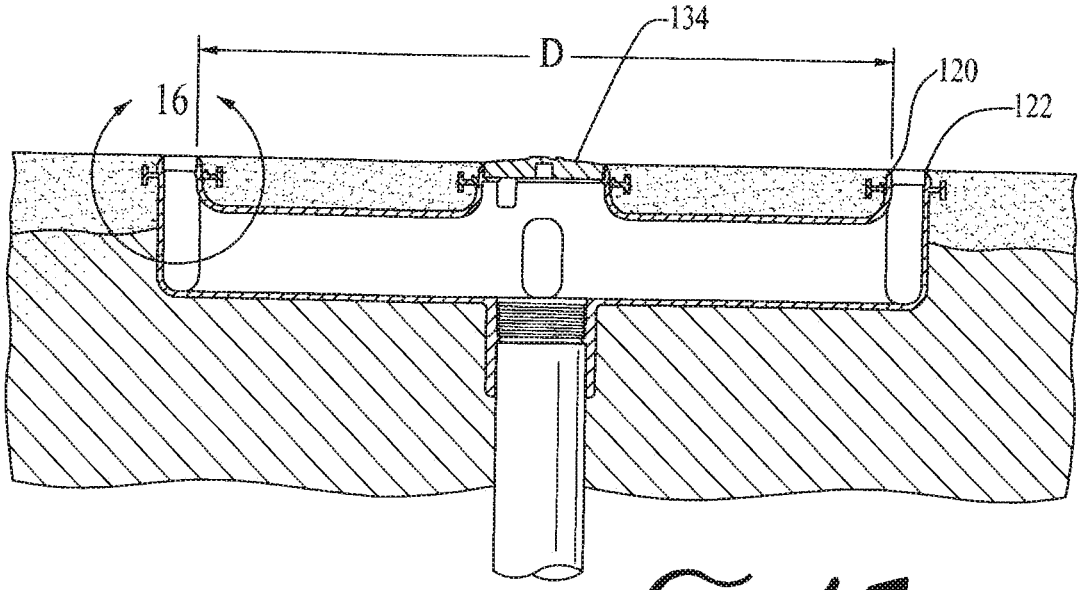
FIG. 15 is an enlarged portion of FIG. 14.
Figure 16:
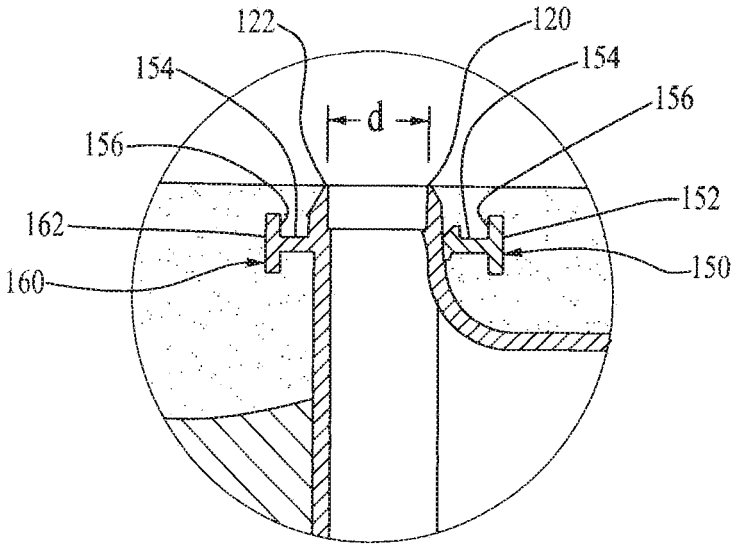
FIG. 16 is an enlarged section view of the water stop feature.

Now also referring to FIGS. 13-16, a second alternate embodiment 110 is discussed. This drain 110 has a round sump body 112, and an inner leaf trapper ring 114 and an outer leaf trapper ring 116. The leaf trapper rings 114, 116 are located concentric to each other and provide a narrow, circular gap 118 (d equals about 0.875 inches wide in FIG. 16) for water to pass but small enough to prevent larger objects from passing such as leaves. As best seen in FIGS. 15, 16, the leaf trapper rings 114, 116 have upper surfaces 120, 122 which are substantially flat and approximately align with one another. This embodiment 110 may include a temporary plaster cover 36 as described above; it does not include the circular grid cover 22. The end result is a highly effective drain system flush with the surface of the pool, with plaster or other aggregate material having the same color and texture both inside and outside the concentric rings or circular grid. The drain has a nearly invisible, pleasing aesthetic appearance. The drain is a safe, VGB compliant drain, large enough to be unblockable by a single person. The drain is rugged, not susceptible to being easily damaged, and the water stop feature helps maintain the structural integrity of the surrounding plaster in the pool or spa floor for many years.

While the apparatus and method have been described in detail with reference to specific embodiments thereof, it will be apparent to one skilled in the art that various changes and modifications can be made therein, without departing from the spirit and scope thereof. Thus, it is intended that the present description cover that modifications and variations of the apparatus and method provided, while it is only the appended claims and their equivalents which define the scope of the invention.

What is claimed is:

1. A low profile drain for installation in a surface of a swimming pool or spa formed of a surface material and having a drain inlet, the low profile drain comprising:

a sump defining an annular chamber embedded in the surface when installed, the sump forming a top side defining an annular top opening no less than about eighteen inches in inner diameter exposed through the surface, the sump forming an outer sidewall and an inner sidewall on opposite sides of the annular top opening, the outer sidewall having an upper peripheral edge about the annular top opening;

the sump having a water stop extending radially therefrom and adjacent to the upper peripheral edge for stopping intrusive migration of water downward between the sump and the surface material thereabout and for embedded anchoring in the surface when installed;

the sump having an outlet port formed laterally through one sidewall thereof for communication between the annular chamber and the drain inlet disposed within the surface material when installed, the annular chamber spanning beneath the annular top opening to receive water admitted therethrough, the sump being configured to maintain open communication between the annular top opening and the outlet port, the annular top opening extending without substantial interruption about a center axis of the sump;

the sump being configured to receive water admitted through the annular top opening into the annular chamber and guide the water to the drain inlet through portions of the sump embedded in the surface when installed; and the sump being configured with the annular top opening surrounding surface material substantially filling the space inside the inner sidewall when the low profile drain is installed, the top side of the sump defining the annular top opening to be substantially flush with the surface when the low profile drain is installed, and portions of the sump radially inside the inner sidewall and radially outside the outer sidewall being substantially covered by the surface material to blend in with the surface when the low profile drain is installed.

2. The low profile drain recited in claim 1, wherein a portion of the sump is removable from above for access to a connection to the drain inlet for purposes of cleaning out the drain inlet, the connection communicating with the annular chamber through the outlet port.

3. The low profile drain recited in claim 1, wherein the outlet port is formed through the inner sidewall of the sump.

4. The low profile drain as recited in claim 1 further comprising a drain cover coupled to the sump to cover above the annular top opening.

5. The low profile drain as recited in claim 1, wherein both the inner and outer sidewalls are formed with the water stop, the water stop extending radially inward from the inner sidewall and radially outward from the outer sidewall, the water stop including a horizontal shelf and a vertical wall collectively forming a tray shape.

6. The low profile drain as recited in claim 2, wherein the connection to the drain inlet is centrally disposed in the sump, and the sump is formed with a plurality of the outlet ports and includes a plurality of radial conduits each extending between one of the outlet ports and the connection.

7. The low profile drain as recited in claim 2, wherein the connection to the drain inlet is centrally disposed in the sump, and the connection includes a hub extending upwardly to be about coplanar with the top side defining the annular top opening.

8. The low profile drain as recited in claim 7, wherein the portion of the sump removable from above the connection includes a central cap no greater than about 2.5 inches in diameter.

9. The low profile drain as recited in claim 1, wherein a connection to the drain inlet is configured to extend below the annular top opening in elevation relative to the surface and formed with a portion disposed radially inward of the annular top opening.

10. A low profile drain for installation in a surface of a swimming pool or spa formed of a surface material and having a drain inlet, the low profile drain comprising:

a sump defining an annular chamber embedded in the surface when installed, the sump forming a top side defining an annular top opening no less than about eighteen inches in inner diameter exposed through the surface, the sump forming an outer sidewall and an inner sidewall on opposite sides of the annular top opening, the outer sidewall having an upper peripheral edge about the annular top opening;

the sump having a water stop extending radially therefrom and adjacent to the upper peripheral edge for stopping intrusive migration of water downward between the sump and the surface material thereabout and for embedded anchoring in the surface material when installed;

the sump having an outlet opening formed laterally through one sidewall thereof for communication between the annular chamber and the drain inlet within the surface material when installed, the sump being configured to maintain open communication between the annular top opening and the outlet opening, the annular top opening extending without substantial interruption about a center axis of the sump;

the sump being configured to receive water admitted through the annular top opening and guide the water to the drain inlet through portions of the sump embedded in the surface material when installed; and the sump being configured with the annular top opening surrounding surface material disposed to substantially fill a space surrounded by the inner sidewall when the low profile drain is installed, the top side of the sump defining the annular top opening to be substantially flush with the surface when the low profile drain is installed, and portions of the sump radially inside the inner sidewall and radially outside the outer sidewall being substantially covered by the surface material to blend in with the surface when the low profile drain is installed;

wherein the water stop includes a horizontal shelf extending radially from the outer sidewall, the water stop being endlessly looped about the outer sidewall.

11. The low profile drain as recited in claim 10, wherein the sump defines the annular chamber to span beneath the annular top opening to receive water admitted therethrough, a connection to the drain is radially displaced from the annular top opening, and the connection communicates with the annular chamber through the outlet opening.

12. The low profile drain as recited in claim 10, wherein a connection to the drain inlet is configured to extend below the annular top opening in elevation relative to the surface and formed with a portion disposed radially inward of the annular top opening.

13. A sump drain for installation in a surface of a swimming pool or spa formed of a surface material and having a drain inlet, the sump drain comprising:

a body defining a ring-shaped chamber partially embedded in the surface material, the body forming an outer sidewall and an inner sidewall on opposite sides of a top opening through the surface, the top opening forming a ring, the outer and inner sidewalls being respectively surrounded by and surrounding portions of the surface when installed;

the body having an outlet port formed laterally through one sidewall thereof, the ring-shaped chamber in fluid communication through the outlet port with a connection disposed in open communication with the drain inlet;

the connection being smaller in circumference than the top opening, the connection being configured to extend below the top opening in elevation relative to the surface and having a portion disposed radially inward of the top opening;

a removable portion defined above the connection; and at least a first water stop surrounding the top opening for stopping intrusive migration of water downward between the body and the surface material thereabout, the first water stop extending radially from the body to be embedded within the surface material below the surface;

wherein the top opening is defined to extend fully without substantial interruption about a center axis of the body, portions of the body defining the top opening remaining substantially flush with the surface when the sump drain is installed in the swimming pool or spa.

14. The sump drain as recited in claim 13 further comprising a removable grid cover coupled to the body to span the top opening.

15. The sump drain as recited in claim 13, wherein the first water stop includes a horizontal shelf and a vertical wall collectively forming a gutter.

16. The sump drain as recited in claim 13, wherein the first water stop is endlessly looped about the top opening, and the ring-shaped chamber is disposed to receive water admitted through the top opening.

17. The sump drain as recited in claim 16, wherein the body is formed with a plurality of the outlet openings and includes a plurality of radial conduits each extending between one of the outlet openings and the connection.

18. The sump drain as recited in claim 13, wherein the removable portion is no greater than about 2.5 inches in diameter, and is separate from the body.

19. The sump drain as recited in claim 13, wherein the removable portion closes a top end of the connection.

20. The sump drain as recited in claim 13, comprising a second water stop extending from the body to be embedded within the surface material below the surface, the second water being endlessly looped and disposed radially inward relative to the top opening, the ring-shaped chamber being disposed to receive water admitted through the top opening.

* * * * *